United States Patent [19]

Fujimori

[11] Patent Number: 4,628,789

[45] Date of Patent: Dec. 16, 1986

[54] TONE EFFECT IMPARTING DEVICE

[75] Inventor: Junichi Fujimori, Hamamatsu, Japan

[73] Assignee: Nippon Gakki Seizo Kabushiki Kaisha, Hamamatsu, Japan

[21] Appl. No.: 738,872

[22] Filed: May 29, 1985

[30] Foreign Application Priority Data

Jun. 1, 1984 [JP] Japan ..... 59-110683

[51] Int. Cl.[4] ..... G10H 1/043; G10H 1/053

[52] U.S. Cl. ..... 84/1.24; 84/1.25; 84/DIG. 4; 84/DIG. 26; 381/61; 381/62; 381/63; 381/118

[58] Field of Search ..... 84/1.24–1.27, 84/DIG. 4, DIG. 26; 381/61–65, 118

[56] References Cited

U.S. PATENT DOCUMENTS

| | | | |
|---|---|---|---|
| Re. 29,490 | 12/1977 | Shamma | 381/61 |
| 4,224,856 | 9/1980 | Ando et al. | 84/1.24 X |
| 4,241,235 | 12/1980 | McCanney | 381/61 |
| 4,276,802 | 7/1981 | Mieda | 84/1.24 X |
| 4,338,581 | 7/1982 | Morgan | 84/1.24 X |
| 4,377,961 | 3/1983 | Bode | 84/1.24 X |
| 4,472,834 | 9/1984 | Yamamuro et al. | 381/61 |
| 4,472,993 | 9/1984 | Futamase et al. | 84/1.24 |
| 4,495,640 | 1/1985 | Frey | 381/61 |

FOREIGN PATENT DOCUMENTS

| | | |
|---|---|---|
| 57-14894 | 6/1982 | Japan . |
| 58-50595 | 4/1983 | Japan . |

*Primary Examiner*—S. J. Witkowski

*Attorney, Agent, or Firm*—Spensley Horn Jubas & Lubitz

[57] ABSTRACT

Tone signals from plural keyboard systems are supplied to an effect imparting circuit via a distribution circuit. The effect imparting circuit comprises plural effect imparting channels and the device can impart a tone effect independently to a tone signal provided to each of the effect imparting channels. The distribution circuit distributes tone signals from the respective keyboard systems to any one or more of the effect imparting channels. An effect selection device is provided for selecting tone effects for the respective keyboard systems and an effect assignment device is also provided for assigning the effects selected in the respective keyboard systems to any of the effect imparting channels according to the selection by this effect selection device. The distribution circuit delivers the respective tone signals to the proper effect imparting channels respectively as controlled by the effect selection and the effect assignment. Thus small number of effect imparting channels are used for impartation of versatile effects.

11 Claims, 5 Drawing Figures

TONE EFFECT IMPARTING DEVICE

BACKGROUND OF THE INVENTION

This invention relates to a tone effect imparting device used for imparting musical tone effects to tone signals in an electronic musical instrument or other tone generation or reproducing devices.

According to the prior art different effects are imparted to tone signals by providing exclusive effect imparting circuits separately for respective tone effects. This provision of separate exclusive circuits however is disadvantageous both in the size and cost of manufacture of the device. For eliminating the disadvantage, Japanese Preliminary Patent Publication No. 14894/1982 discloses a single effect imparting circuit (a modulation circuit) shared commonly for various effects. The effect imparting circuit can impart only one effect at a time and an effect selection switching circuit is constructed in such a manner that it selects only one effect preferentially when plural effects have been selected simultaneously. An improved type of effect imparting device is disclosed in Japanese Preliminary Patent Publication No. 50595/1983. According to this device, the effect imparting function of a single effect imparting circuit is programmable and plural effects can be simultaneously imparted on a time shared basis. In this device, however, the manner of utilizing the effect imparting circuit on a time shared basis is limited to several modes only and the device cannot be freely utilized on a time shared basis for providing any desired combination of effects. There still remains a problem in this prior art as to whether a simple construction can be provided if there is a large number of selectable effects and if there are plural systems of tone signals to which these effects are to be imparted independently from one another.

It is therefore an object of the invention to provide a tone effect imparting device of as simplified a construction as possible which is capable of selectively imparting plural effects simultaneously from among many types of musical tone effects and also capable of effecting a tone effect imparting control independently for each of the tone signals from plural systems.

SUMMARY OF THE INVENTION

Tone signals from plural tone generating systems are applied to the effect imparting device according to the invention. Effect selection means capable of selectively setting types of effects to be imparted to tones with respect to these plural systems is provided. Effect imparting channels capable of independently imparting effects to the applied tone signals are also provided. Effect assignment means is provided for assigning to each of the effect imparting channels an effect to be imparted to the channel in response to the selection by the effect selection means. In the respective effect imparting channels, the applied tone signals are imparted independently with the effects which have been assigned by the effect assignment means. Distribution means is provided for selectively distributing the applied tone signals from the plural systems to the respective effect imparting channels. This distribution means distributes the tone signals from the respective systems in accordance with distribution information supplied to it by the effect assignment means.

Effects which have been selected as desired by the effect selection means with respect to the plural systems are assigned to the effect imparting channels in the effect assignment means. Data assigned includes the type of the effect assigned to each effect imparting channel and the tone system which is to be imparted with the effect. The distribution means distributes tone signals from the respective tone generation systems to specified effect imparting channels in accordance with distribution information included in the the assigned data. In the respective effect imparting channels, the assigned effects are imparted to the tone signals distributed thereto.

Since there are plural effect imparting channels and the associated effect assignment means, plural effects can be selectively imparted simultaneously from among many types of effects. Moreover, since tone signals from plural systems are distributed to the respective effect imparting channels in accordance with assigned data on a time shared basis to impart assigned effects to the tone signals from the respective systems, it is not necessary to provide an exclusive effect imparting circuit or effect imparting channel for each system and, accordingly, the construction of the device can be remarkably simplified.

BRIEF DESCRIPTION OF THE DRAWINGS

In the accompanying drawings.

DESCRIPTION OF PREFERRED EMBODIMENTS

With reference to the accompanying drawings, an embodiment of the invention will be described.

Figure 1:
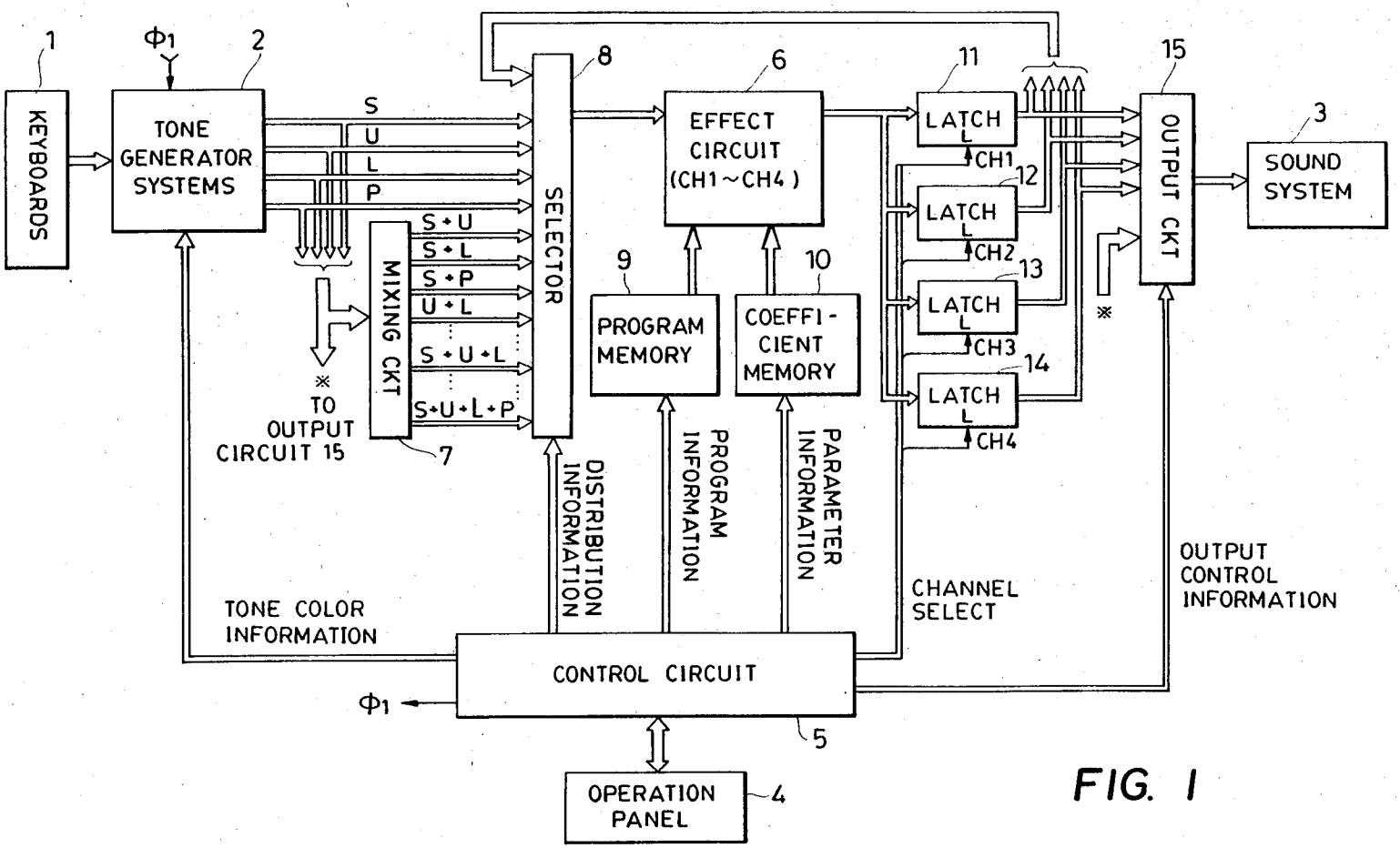
FIG. 1 is an electrical block diagram showing an embodiment of the invention.

FIG. 1 shows an embodiment of the effect imparting device according to the invention applied to an electronic musical instrument having keyboards 1. In the figure, the portion other than the keyboards 1, a tone generator systems 2 and a sound system 3 constitutes the effect imparting device. By way of example, the keyboards 1 comprises four keyboards, namely a solo keyboard, an upper keyboard, a lower keyboard and a pedal keyboard. The tone generator systems 2 generate digital tone signals for notes of the keys depressed in the keyboards 1 separately for four tone generating systems corresponding to the respective keyboards. For the sake of convenience, the solo keyboard system is herein designated by reference character S, the upper keyboard by U, lower keyboard by L and the pedal keyboard by P.

An operation panel 4 comprises effect selection switches and tone color selection switches enabling selection of tone colors and effects for each of the systems S, U, L and P.

A control circuit 5 performs various functions including: detecting on-off operations of the switches in the operation panel 4 and controlling a display in the operation panel 4, assigning a selected effect corresponding to one of the systems S-P to the respective effect imparting channels according to the selection by the effect selection switches, controlling circuits in the effect imparting device in accordance with the data (effect determining parameters) assigned, and supplying tone color information to the tone generator systems 2 responsive to actuation of the tone color selection switches. The control circuit 5 is constructed, for example, of a microcomputer. The tone generator systems 2 establish tone colors of the respective tone signals in the systems S, U, L and P in accordance with the tone color information supplied by the control circuit 5.

An effect circuit 6 function as a plurality (e.g. four) of effect imparting channels CH1–CH4. In this embodiment, the four effect imparting channels CH1–CH4 are formed by commonly using a single hardware circuit on a time shared basis.

A mixing circuit 7 and a selector 8 constitute the above described distribution means. The mixing circuit 7 mixes tone signals generated by any two systems, by any three systems and by all of the four systems in the tone generator systems 2 (i.e. producing eleven sets of signals: S+U, S+L, S+P, U+L, U+P, L+P, S+U+L, S+U+P, S+L+P, U+L+P and S+U+L+P) and outputs these mixed tone signals. The individual tone signals from the four systems S–P in the tone generator systems 2 and the eleven mixed tone signals S+U through S+U+L+P produced by the mixing circuit 7 are applied to the selector 8. The selector 8 selects one of the tone signals or combination sets S through P and S+U through S+U+L+P in response to distribution information provided by the control circuit 5 in synchronism with the time division timing of the respective channels CH1–CH4 and supplies the selected signals to the effect circuit 6. The distribution information designates, in accordance with the effect data assigned to the effect imparting channels CH1–CH4, one of the systems S–P or one of the mixed systems S+U through S+U+L+P at a timing corresponding to a time division time slot of the respective channels CH1–CH4. Since it is possible to have a case in which an effect common to the respective systems S–P may be imparted depending upon the selection of the effects, the mixing circuit 7 is provided to cope with such situations by adding and mixing tone signals and supplying them to the effect circuit 6 in correspondence to the common effect imparting channel.

The effect circuit 6 is capable of changing its effect imparting function programmably as in the similar circuit disclosed in Japanese Preliminary Patent Publication No. 50595/1983. A program memory 9 prestores an operation program for the effect circuit 6 for realizing various effect imparting functions performable in the effect circuit 6. This operation program includes control signals such as control signals for gates and selectors, control signals for registers and operation command signals. The program memory 9 is accessed by program information provided by the control circuit 5. This program information designates, in accordance with the effect data assigned to the effect imparting channels CH1–CH4, the operation program corresponding to the particular effect assigned to the channel at a timing corresponding to the time division time slot of the channel. In this manner, the operation programs corresponding to the respective effects assigned to the respective channels CH1–CH4 are read out from the program memory 9 and the control signals and operation command signals constituting the operation program are supplied to the effect circuit 6. The effect circuit 6 imparts an input tone signal with the effect which is determined in accordance with the operation program, i.e., control signals and operation command signals, provided for each of the effect imparting channels CH1–CH4.

With regard to effects such as a modulation effect and a reverberation effect of which the degree of effect impartation can be controlled by coefficients, coefficient data are read out from a coefficient memory 10 and supplied to the effect circuit 6. The control circuit 5 generates, in accordance with the effect data assigned to the effect imparting channels CH1–CH4, parameter information corresponding to the particular effect assigned to each of the channels CH1–CH4 at a timing corresponding to the time division time slot of the channel. This parameter information is supplied to the coefficient memory 10 to cause coefficient data corresponding to this parameter information to be read out. The effect circuit 6 uses this coefficient data in the operation for imparting the effect determined by the above described operation program.

The digital tone signals imparted with the effects and delivered out of the effect circuit 6 are distributed to among four latch circuits 11–14 corresponding to the respective channels CH1–CH4. To latch control inputs L of the respective latch circuits 11–14 are applied respective channel select signals from the control circuit 5 and at the end of the time division time slots of the respective channels CH1–CH4, a digital tone signal for which the effect imparting processing has been made during the time slot is latched in one of the latch circuits 11–14 corresponding to the channel.

The tone signals of the respective channels CH1–CH4 which have been converted to parallel data in the latch circuits 11–14 are applied to an output circuit 15 and also to the selector 8. To the output circuit 15 is also applied tone signals (* mark in FIG. 1) of the four systems S–P (not imparted with the effect) generated by the tone generator systems 2. The output circuit 15 selects and mixes the tone signals imparted with the effects and the tone signals of the systems not imparted with the effects in accordance with the output control information provided by the control circuit 5 and outputs the mixed signals. The output tone signals of the output circuit 15 are supplied to the sound system 3 via a digital-to-analog converter not shown.

A feedback route from the latch circuits 11–14 to the selector 8 is provided for imparting different effects serially to tone signals of the same system. If, for example, two different effects are to be imparted to a tone signal of the system S, a tone signal of the system S is selected by the selector 8 at the time division timing of the first channel CH1 and supplied to the effect circuit 6 to impart the first effect and thereafter this tone signal of the system S imparted with the first effect is latched in the latch circuit 11. At the time division timing of the next channel CH2, the tone signal having been imparted with the first effect and latched in the latch circuit 11 is selected by the selector 8 through the feedback route and applied to the effect circuit 6 to be imparted with the second effect and thereafter is latched in the latch circuit 12. In the foregoing manner, the first effect and the second effect are serially imparted to the tone signal of the system S and the tone signal thus imparted with the two effects is latched in the latch circuit 12. In this case, if the output of the latch circuit 11 which has been imparted with the first effect only is unnecessary, a control can be effected so that the output of the latch circuit 11 will not be selected by the output circuit 15.

Conversely, if different effects are to be imparted in parallel to a tone signal of the same channel, the above described feedback route is not used. If, for example, two different effects are to be imparted in parallel to a tone signal of the system S, the tone signal of the system S is selected by the selector 8 at the time division timing of the channel CHl and the selected signal is applied to the effect circuit 6 to be imparted with the first effect and a resulting signal is latched in the latch circuit 11. A tone signal of the system S is selected by the selector 8 at the time division timing of the next channel CH2 also and the selected signal is applied to the effect circuit 6 to be imparted with the second effect and a resulting signal is latched in the latch circuit 12. The output circuit 15 selects both the outputs of the latch circuits 11 and 12 and mixes them together.

Figure 2:
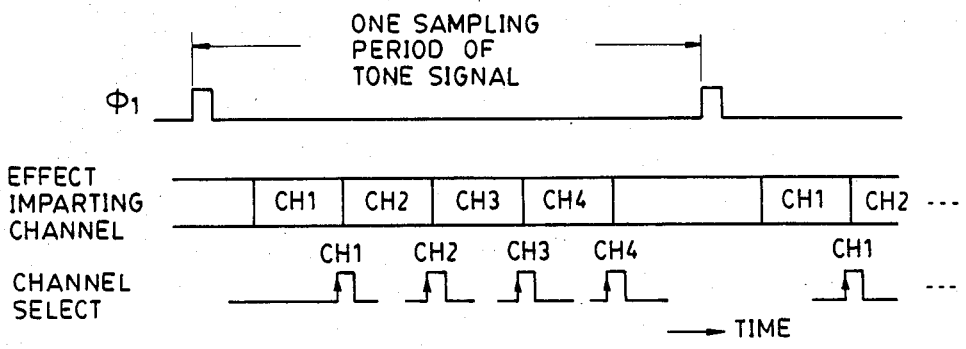
FIG. 2 is a time chart showing timings of time division effect imparting channels in the same embodiment.

The time division channel timing of the effect circuit 6 corresponds to one sampling period of the tone signals generated in the tone generator systems 2. FIG. 2 shows an example of time division time slots of the effect imparting channels CH1–CH4 in which $\phi_1$ represents a sampling clock pulse synchronized with one sampling period of the tone signal. FIG. 2 shows also an example of channel select signals for the respective channels CH1–CH4 used in the respective latch circuits 11–14.

A specific example of the effect assignment processing will now be described with reference to FIGS. 3, 4*a* and 4*b*.

Figure 3:
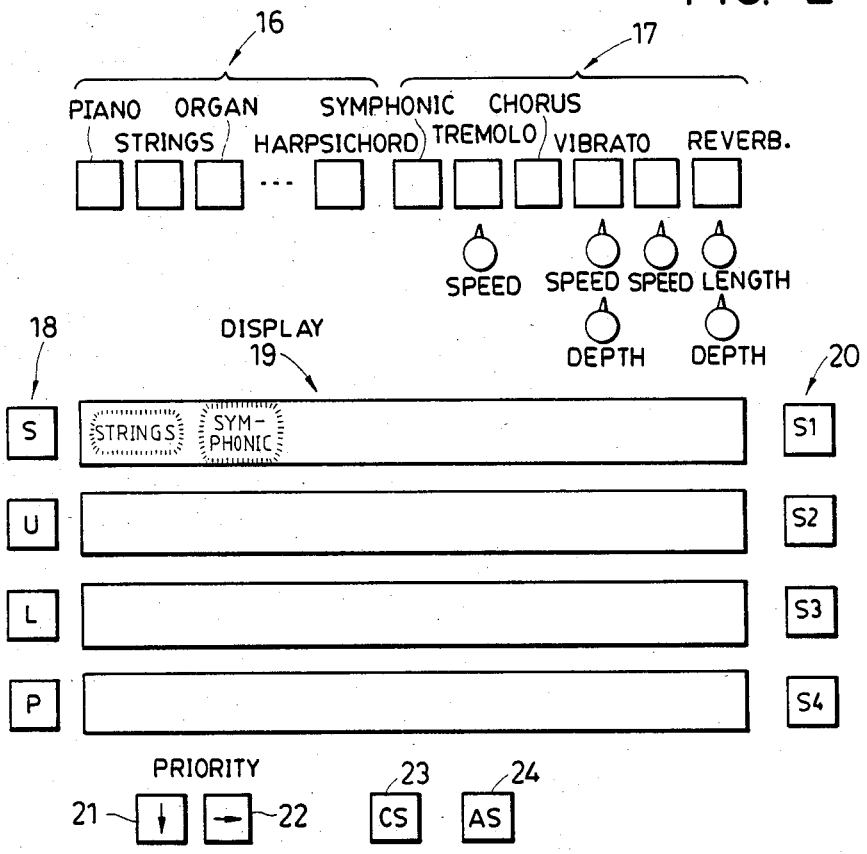
FIG. 3 is a plan view of an example of an operation panel in the same embodiment.

FIG. 3 shows an example of the operation panel 4. Reference character 16 designates tone color selection switches corresponding to various tone colors such as piano, strings and organ and reference character 17 designates effect selection switches corresponding to various effects such as symphonic, tremolo and chorus effects. Attached to particular ones of the effect selection switches 17 are operators for selectively setting parameters such as "speed", "depth" and "length". Switches 18 affixed with symbols S, U, L and P are ones for selecting the systems S–P. Elongated displays 19 extending on the right side of the selection switches 18 of the respective systems S–P display tone colors and effects selected by the tone color selection switches 16 and the effect selection switches 17 with respect to the respective systems S–P. Displays indicating the selected tone color and effect are respectively lit in the display 19. Switches 20 affixed with symbols S1–S4 provided on the right side of the respective displays 19 perform selection as to whether the effects should be imparted serially or in parallel in case different effects have been selected in the same system.

Switches 21 and 22 are priority order selection switches. In the present embodiment, the effect assignment processing is made in a predetermined priority order and these switches are provided for selecting the priority order. The switch 21 affixed with the downwardly directed arrow selects a "vertical priority". The vertical priority is a processing in which one effect is preferentially selected from among the effects selected by each of the channels S–P in the order of the systems S, L, U and P and the preferentially selected effect is sequentially assigned to the first available channel among effect imparting channels CH1–CH4. In this case, if there are available channels among the channels CH1–CH4 left after the preferential selection by the first effect still another effect is preferentially selected with respect to the rest of the effects in the order of the systems S, U, L and P.

The switch 22 affixed with the rightwardly directed arrow selects "horizontal priority". The horizontal priority is a processing in which the system S is given the first priority and effects which have been selected for this system S are preferentially selected in a predetermined order (the priority order among the respective effects is predetermined with respect, e.g., to the tone colors) and the selected effects are sequentially assigned to the effect imparting channels CH1–CH4. If there are available channels left after the preferential selection, a similar preferential selection is performed in the order of the systems U, L and P.

A switch 23 affixed with symbol CS is provided for selecting whether or not identical or similar effects between different systems should be assigned commonly to a common effect imparting channel. If, for example, the switch CS is switched on when the same vibrato effect is selected in the systems U and L, the vibrato effect is assigned to one effect imparting channel and the signal U+L which is a sum of the tone signal of the system U and that of the system L is distributed to this channel.

An automatic imparting switch 24 affixed with symbol AS is provided for selecting an automatic imparting function according to which, when there are available channels left after all of the selected effects have been assigned to the effect imparting channels CH1–CH4, an effect suited to a tone color which has been selected in some system is automatically selected and assigned to an empty channel together with information concerning this system. If, for example, the tone color of violin has been selected but the vibrato effect has not been selected in a certain system, the vibrato effect which is suited to the tone color of violin is automatically imparted.

The function performed by the coupling switch 23 is useful in efficiently utilizing the limited number of effect imparting channels CH1–CH4 for assignment of many types of effects. The function performed by the automatic imparting switch 24 is useful in effectively utilizing an empty channel without waste for increasing the musical effect. The functions performed by the priority order selection switches 21 and 22 are advantageous in that, when the effects selected outnumber the available channels, priority of assignment can be controlled by a player.

An example of the manner of selecting a tone color and effects using the operation panel of FIG. 3 will now be described. The selection is made by a combination of the system selection switch 18 with the tone color selection switch 16 or the effect selection switch 17. If, for example, the tone color of "strings" and the effects of "symphonic" and "vibrato" are to be selected in the system S, the switch "S" in the system selection switches 18 is depressed to turn the selection mode to the mode of the system S and then the switch of the "strings" in the tone color selection switches 16 is depressed in this mode and further the switches of "symphonic" and "vibrato" are depressed. Since the parameters of "speed" and "depth" set by the parameter setting operators corresponding to the vibrato switch are read simultaneously upon depression of the vibrato switch, desired contents are set before depression of the switch. Upon selection of the tone color and the effects in this manner, the selected contents are displayed by lighting an indicator on the display 19. For cancelling the once selected tone color or effects, the corresponding tone color selection switch 16 or effect selection switch 17 is depressed again. For clearing the system selection mode of the system selection switch 18, the same switch is depressed again. Processings such as detection of depression of these switches and subsequent signal storing and displaying are executed by a microcomputer included in the control circuit 5 or otherwise executed employing known techniques of which description in detail will be omitted. Selection of plural tone colors and effects for one tone generating system is possible.

For better understanding of the invention, an example of a special processing in the effect assignment will be described. Assume, for example, that the following effects have been selected in the systems S–P by operating the switches 17 and 18:

S—symphonic, tremolo
U—symphonic, vibrato
L—tremolo, chorus
P—reverberation

If, in this case, the selection of function by the coupling switch 23 is off and the "vertical priority" function by the switch 21 is on, the effects of symphonic in S, symphonic in U, tremolo in L and reverberation in P are assigned to the channels CH1–CH4. If the horizontal priority function by the switch 22 is on, the effects of symphonic and tremolo in S and symphonic and vibrato in U are assigned to the channels CH1–CH4. If at this time the switch of S1 corresponding to the system S is on and the switch S2 corresponding to the system U is off in the series/parallel selection switch 20, symphonic and tremolo in the system S become serial effects whereas symphonic and vibrato in the system U become parallel effects.

If the selection of function by the coupling switch 23 is on in the above described example of effect selection, the symphonic of S+U, the tremolo of S+L, the reverberation of P and the vibrato of U are assigned to the respective channels CH1–CH4 when the "vertical priority" function is on. Conversely, when the horizontal priority function by the switch 22 is on, the symphonic of S+U, the tremolo of S+L, the vibrato of U and the chorus of L are assigned to the respective channels.

An example of the effect assignment processing program executed by the control circuit 5 will be described with reference to FIGS. 4*a* and 4*b*. This program is executed when any of the switches and operators has been operated in the operation panel 4.

Figure 4A:
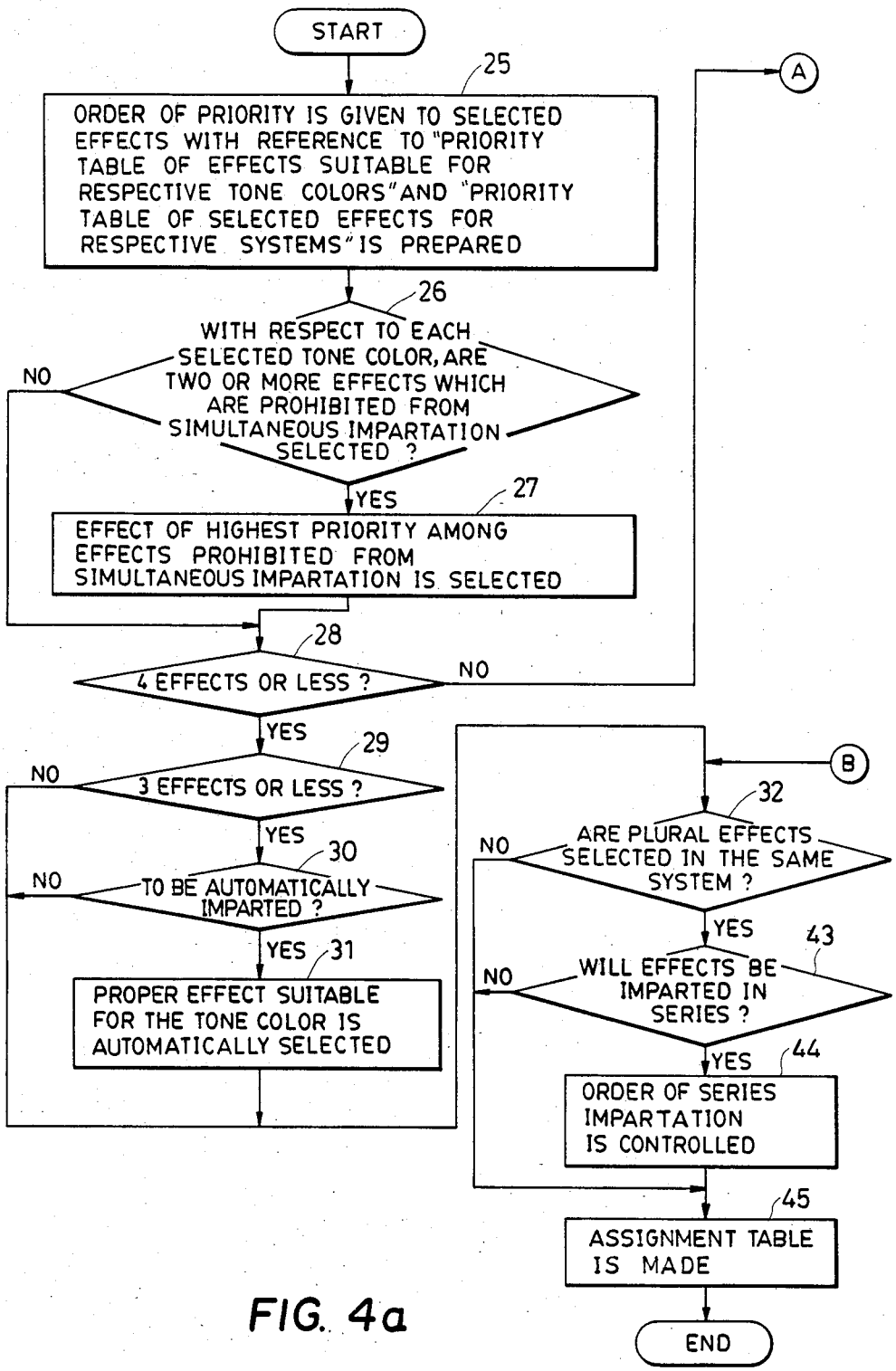
FIGS. 4*a* and 4*b* are flow charts showing an example of an effect assignment program executed in a control circuit of the same embodiment.

Referring to FIG. 4*a*, in step 25, a previously prepared "priority table of effects suitable for respective tone colors" is referred to and the order of priority is given to effects which have been selected for the respective systems S–P in accordance with the tone colors selected for the respective systems and thereupon a "priority table of selected effects for respective systems" is prepared. If, for example, the priority order such as the symphonic effect for the tone color of strings and the vibrato effect for the tone color of violin are established in the priority table of effects suitable for respective tone colors, and if the tone color of strings and the symphonic and vibrato effects are selected for the system S and the tone color of violin and the symphonic and vibrato effects have been selected for the system U, the symphonic effect is given the first priority to the system S whereas the vibrato effect is given the first priority to the system U.

In step 26, a previously prepared "table of combination of effects which are prohibited from simultaneous impartation for respective tone colors" is referred to and whether or not two or more effects which are prohibited from simultaneous impartation to a selected tone color have been selected is examined. If the result of checking is YES, the processing proceeds to step 27 in which a single effect of the highest priority among the two or more effects prohibited from simultaneous impartation is selected and the other effects are prohibited. In judging the priority order in this step 27, the priority table of selected effects for respective systems prepared in step 25 is referred to. Examples of effects of which the simultaneous imparting is prohibited are the vibrato and tremolo effects with respect to the tone colors of piano and harpshichord and the tremolo and chorus effects with respect to the tone color of organ. The prohibition of simultaneous imparting of effects is adopted for preventing mutual cancelling or deterioration of musical effects.

In step 28, it is determined whether or not the selected effects (including those which have been removed in the step 27) are four or less (i.e., not more than the number of the effect imparting channels). If the number is four or less, all of the selected effects can be assigned to the effect imparting channels CH1–CH4. Otherwise, the selected effects must be adjusted suitably before they are assigned to the respective channels CH1–CH4.

If step 28 is YES, the processing proceeds to step 29 in which whether the selected effect are three or less or not is examined. If the number is three or less, it means that there is at least one available channel left after assigning all of the selected effects. Then, if step 29 is YES, the processing proceeds to step 30 in which whether the automatic imparting switch 24 (FIG. 3) is on or not is examined. If the answer is YES, the processing proceeds to step 31 in which proper effects are automatically selected by the number of available channels. In this step, one of the selected tone colors is selected in accordance with the selected effect with reference to previously prepared "priority table of tone color suitable for respective effects" and "priority table of effect suitable for respective tone colors" and an effect suitable for this selected tone color is automatically selected. If, for example, the vibrato effect has been selected when the selected tone color is violin, the vibrato effect is automatically selected for the system in which the tone color of violin has been selected. After completion of step 31, the processing proceeds to step 32. If step 29 or 30 is NO, the automatic selection by step 31 is not effected but the processing proceeds to step 32.

If step 28 is NO, the processing proceeds to step 33 (FIG. 4*b*) in which whether the coupling switch 23 (FIG. 3) is on or not is examined. If the answer is YES, the processing proceeds to step 34 for combining identical or similar effects in different systems into one effect. In the present embodiment, the processing for combining identical or similar effects in different systems into one effect is performed in three stages of steps 34, 36 and 38. In step 34, if the same effects exist in respect of parameters such as "speed", "depth" and "length" as well as the type of the effect, these effects are combined into one effect. Specifically, system addition information (S+U or S+U+L+P or the like) is employed as system information corresponding to the combined effects. After step 34, the processing proceeds to step 35 in which whether or not the number of all of the selected effects after the combining processing has become four or less is examined. If the answer is YES, the processing jumps to step 32 (FIG. 4*a*) and if the answer is NO, the effects are subject to further adjustments.

In step 36, if the same type of effects have been selected in different systems and difference in the set parameter values is too small to be readily recognized between these effects, these effects are combined into one effect. Thereafter, the processing proceeds to step 37 in which whether or not the number of total selected effects has become four or less as a result of combination is examined. If the answer is YES, the processing jumps to step 32 and if the answer is NO, the processing proceeds to step 38. In step 38, if the same type of effects have been selected in different systems, these effects are combined into one effect regardless of the set values of the parameters. Then the processing proceeds to step 39 in which it is determined whether or not the number of total selected effects has become four or less. If the answer is YES, the processing jumps to step 32 and if the answer is NO, the processing proceeds to step 40. The parameters of the effects combined in steps 36 and 40 are determined at suitable values using values set for any of the systems or mean values (averages) of the respective systems.

In step 40, which of the "vertical priority" and "horizontal priority" has been selected by the switch 21 or 22 is examined. In the case where the vertical priority has been selected, the processing proceeds to step 41 in which four effects are preferentially selected according to the previously described routine of the vertical priority, i.e., one effect each is preferentially selected from among effects having been selected in the respective systems in the order of the systems S, U, L and P, the process being repeated until the four effects have been selected. In the case where the horizontal priority has been selected, the processing proceeds to step 42 in which four effects are preferentially selected according to the previously described routine, i.e., four effects are preferentially selected from one of the systems which has been given the first priority in accordance with the priority order in the systems and, if effects in this system fall short of four, the rest of effects are preferentially selected from the system of the next priority order, the processing being subsequently effected from one system to another according to the priority order in the systems until four effects have all been selected. In steps 41 and 42, the priority selection order in the same system is determined referring to the "priority table for selecting effects for respective systems" prepared in step 25. The priority order among the systems is determined referring to a predetermined table. By way of example, priority is given in the order of the systems S, U, L and P among these systems as was previously described and priority is also given to added systems over a single system, added systems of a greater number of addition being given a higher priority. After steps 41 and 42, the processing proceeds to step 32.

In step 32, whether or not plural effects have been selected is examined. If the answer is YES, the processing proceeds to step 43 in which states of depression of the series/parallel selection switches 20 (FIG. 3) affixed with the symbols S1–S4 for the respective systems is examined to judge whether the plural effects in the same system are imparted in series or in parallel. If they are imparted in series, the processing proceeds to step 44 in which the order of imparting effects is controlled with reference to a predetermined table. If, for example, the vibrato and reverberation effects are to be imparted in series, the vibrato effect is imparted first and then the reverberation effect is imparted.

In final step 45, an "assignment table" is prepared on the basis of the preceding processings. The assignment table stores data of types of the effects which have ultimately been determined to be assigned to the four effect imparting channels CH1–CH4 (including their parameters) and names of the systems to which they have been assigned.

The control circuit 5 in FIG. 1 outputs, with reference to the assignment table thus prepared and at each time division timing of the channels CH1–CH4 (FIG. 2), program information and parameter information corresponding to the type of effect assigned to the particular channel and also distribution information corresponding to the tone system assigned to the channel (including added systems).

In the processings of steps 34, 36 and 38 in FIG. 4*b* the combination of effects should preferably be avoided as an exception to the rule in the following case. In a case where imparting of plural effects in series has been selected by the series/parallel selection switch 20 with respect to at least one system in two or more systems in which at least one same type of effect has been selected, if the same effects have been selected in these systems and series imparting of the effects has been selected in all of these systems and further the order of the series imparting of the effects is the same in these systems, then these effects are combined into one effect because there is no inconvenience in doing so. Otherwise, the combination of the same effects causes inconvenience in the imparting in series.

Figure 4B:
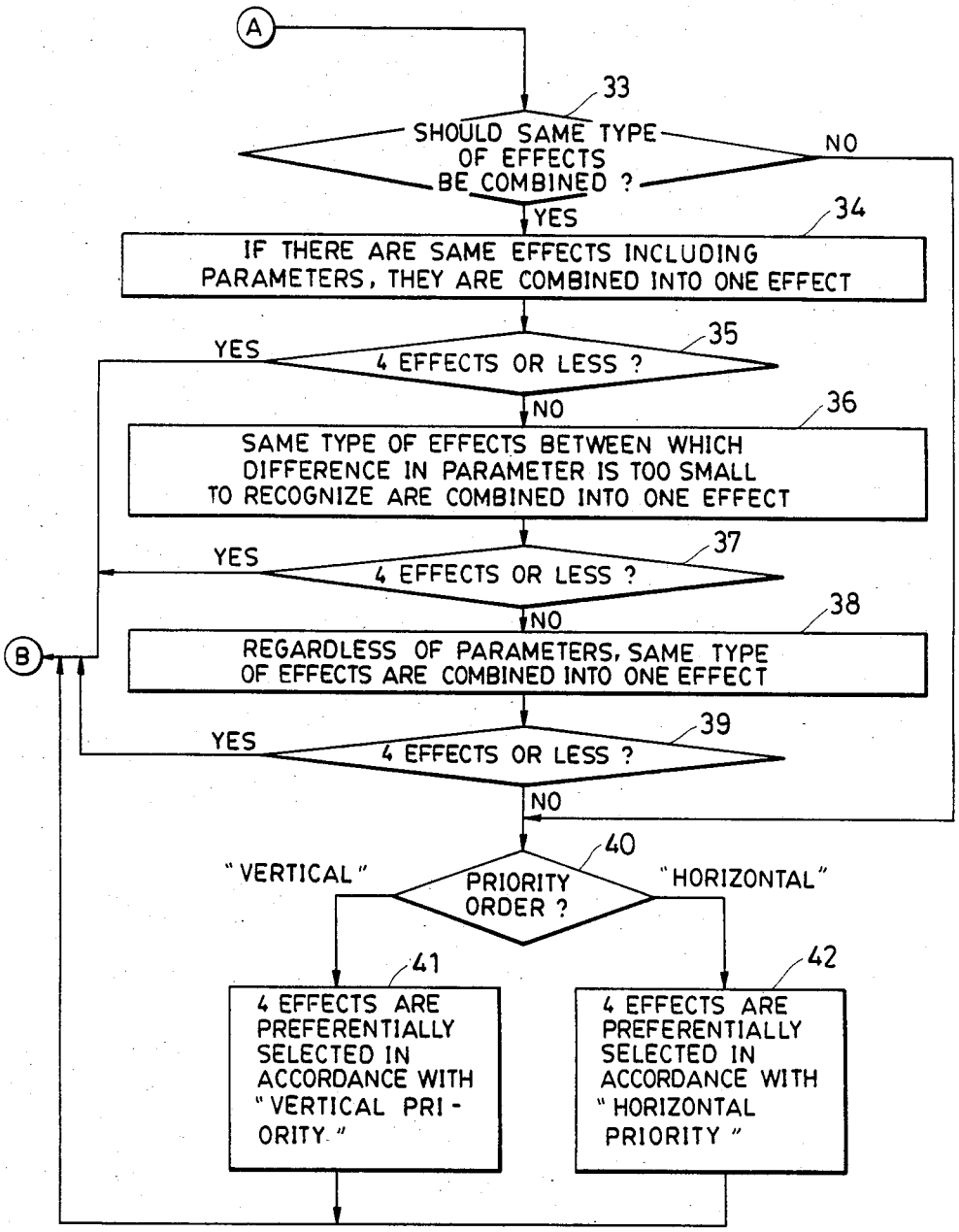

Contents of the tables used in executing the programs of FIGS. 4*a* and 4*b* (e.g., "priority table of effects suitable for tone colors" used in step 25) should preferably remain unfixed, leaving room for rewriting by a user. In this case, a conversation type system may be employed so that the device will interrogate the user when an effect which is not stored in the table has been selected. Further, plural tables may be prepared and selective switching of these tables may be effected automatically or manually during performance of a piece of music.

In the above described embodiment, tone signals of the systems S–P are supplied from the tone generator systems 2 (FIG. 1) to the distribution system in parallel but these signals may be supplied in series in a time division multiplexed state. The systems of tone signals applied to the effect imparting device need not necessarily be distinguished by the keyboard as in the above described embodiment but may be distinguished by key ranges obtained by dividing the keyboard or by different tone generation devices (systems) provided for the same keyboard or key range. In short, the effect need only to be systems of tone signals on which the effect imparting control should be made independently from one another.

In the above embodiment, description has been made on the assumption that the effect imparting channels are fixed to four channels. The number of the effect imparting channels may however be made variable. If, for example, the effect imparting channels are formed on a time shared basis, time required for computation processing is relatively short in one type of effect and relatively long in another effect so that the number of the time division effect imparting channels within one sampling time can be increased or decreased depending upon the time for computation processing.

The effect imparting channels need not be formed on a time shared basis but may be formed by separate hardware circuits.

The tone signals to be processed need not be digital signals but may be analog signals.

As will be apparent from the foregoing description, according to the present invention, many types of effects can be imparted selectively and effectively by employing a limited number of effect imparting channels (i.e., effect imparting circuits) and the selective imparting of effects can be made independently for tone signals of plural systems so that a simplified construction of the device can be realized while many effect imparting functions are derived from the construction.

What is claimed is:

1. A tone effect imparting device comprising:

distribution means capable of receiving tone signals from plural tone generating systems and selectively distributing the respective tone signals to anyone or more of a plurality of effect imparting channels according to distribution information provided to said distribution means;

effect imparting means connected to said distribution means and comprising a plurality of said effect imparting channels, each of said effect imparting channels imparting a tone effect as assigned to the channel to a tone signal distributed thereto by said distribution means;

effect selection means for selecting tone effects to be imparted to tone signals of the respective tone generating systems with respect to each of said systems; and effect assignment means for assigning, responsive to the selection by said effect selection means, the tone effect selected for each system to any of said effect imparting channels and the distribution information to said distribution means such that the distribution of the tone signals from the respective systems by said distribution means and the tone effects to be imparted to the respective channels in said effect imparting means are respectively controlled in accordance with the assignment by said effect assignment means.

2. A tone effect imparting device as defined in claim 1 wherein said effect assignment means selects, if there are selected more tone effects than the number of said effect imparting channels, tone effects of the number corresponding to the number of said effect imparting channels preferentially in accordance with predetermined conditions for preferential selection and assigns these preferentially selected tone effects to the respective effect imparting channels.

3. A tone effect imparting device as defined in claim 2 further comprising a switch for switching the conditions for preferential selection.

4. A tone effect imparting device as defined in claim 1 wherein said effect assignment means is capable of effecting a coupling control in such a manner that, if the same type of tone effects have been selected for the tone signals from the different systems, these effects are combined into one tone effect and assigned to one effect imparting channel, and said distribution means distributes, when the coupling control is effected by said effect assignment means, a sum signal of the tone signals from the different systems corresponding to the combined tone effects to the effect imparting channel to which the combined tone effects have been assigned.

5. A tone effect imparting device as defined in claim 4 further comprising a coupling switch for selecting whether the coupling control should be effected or not.

6. A tone effect imparting device as defined in claim 4 wherein said coupling control is effected if there are selected more tone effects than the number of said effect imparting channels by said effect selection means.

7. A tone effect imparting device as defined in claim 1 wherein said effect assignment means effects an addition control in such a manner that, if the number of the effects selected by said effect selection means is less than the number of said effect imparting channels, additionally assigns a predetermined effect automatically to any available one of said effect imparting channels.

8. A tone effect imparting device as defined in claim 7 further comprising an automatic addition switch for selecting whether said addition control should be effected or not.

9. A tone effect imparting device as defined in claim 1 wherein said distribution means comprises mixing means for adding tone signals of at least two of said systems together and selector means receiving the tone signals added together in said mixing means and also tone signals of the respective systems which are not added together for selecting and outputting the input tone signals for the respective channels in accordance with distribution control information provided by said effect assignment means.

10. A tone effect imparting device as defined in claim 1 further comprising:

a switch for selecting, if a tone signal of the same system is distributed to plural channels and imparted with different tone effects in these channels, whether these channels should be connected in series or in parallel, and means for switching, when the series connection has been selected by this switch, signal connection between the corresponding effect imparting channels in said effect imparting means to the series connection.

11. A tone effect imparting means as defined in claim 1 wherein said effect imparting channels in said effect imparting means are established by using one effect imparting circuit on a time shared basis.

* * * * *